United States Patent [19]

Toyoda

[11] 4,021,152

[45] May 3, 1977

[54] ELECTROMAGNETIC PUMP

[75] Inventor: Akira Toyoda, Tokyo, Japan

[73] Assignee: Taisan Industrial Co., Ltd., Tokyo, Japan

[22] Filed: May 10, 1976

[21] Appl. No.: 685,075

Related U.S. Application Data

[63] Continuation of Ser. No. 530,273, Dec. 6, 1974, abandoned.

[52] U.S. Cl. ..... 417/417; 251/141; 417/311; 417/505; 417/568

[51] Int. Cl.[2] ..... F04B 49/00

[58] Field of Search ..... 417/311, 417, 505, 568; 251/141

[56] References Cited

UNITED STATES PATENTS

| | | | |
|---|---|---|---|
| 3,380,387 | 4/1968 | Kofink | 417/417 |
| 3,523,676 | 8/1970 | Barker | 251/141 |
| 3,670,274 | 6/1972 | Ellison | 251/141 |
| 3,833,015 | 9/1974 | Knever | 251/141 |
| 3,874,822 | 4/1975 | Nakamura | 417/311 |
| 3,877,841 | 4/1975 | Nakamura | 417/311 |

*Primary Examiner*—Martin P. Schwadron
*Assistant Examiner*—Abraham Hershkovitz
*Attorney, Agent, or Firm*—Kane, Dalsimer, Kane, Sullivan and Kurucz

[57] ABSTRACT

An electromagnetic pump of the reciprocating type comprising a relief valve mechanism adapted to minimize the magnitude of pulsations of the fluid delivered by the pump and at the same time to act as a pressure accumulator. The relief valve mechanism comprises a pressure adjusting cylinder maintained in communication with the outlet side of the pump, a spring-loaded balancing plunger slidably mounted in the pressure adjusting cylinder, and a pressure adjusting screw adjustably mounted in the mechanism for regulating the biasing force of the spring so as to adjust the pressure applied by the spring to the balancing plunger to any level as desired. The pressure adjusting cylinder is formed therein with a relief port through which communication can be maintained between the outlet side of the pump and the suction side of the pump when a rise in the delivery pressure of the pump causes the pressure adjusting plunger to move rearwardly a predetermined distance against the biasing force of the pressure adjusting spring, whereby the delivery pressure of the pump can be maintained at a predetermined level at all times by spilling off the excess fluid from the pressure adjusting cylinder through the relief port.

2 Claims, 2 Drawing Figures

FIG. 2
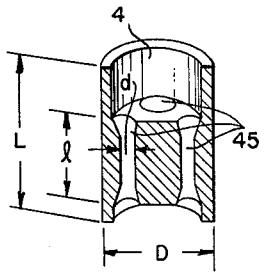
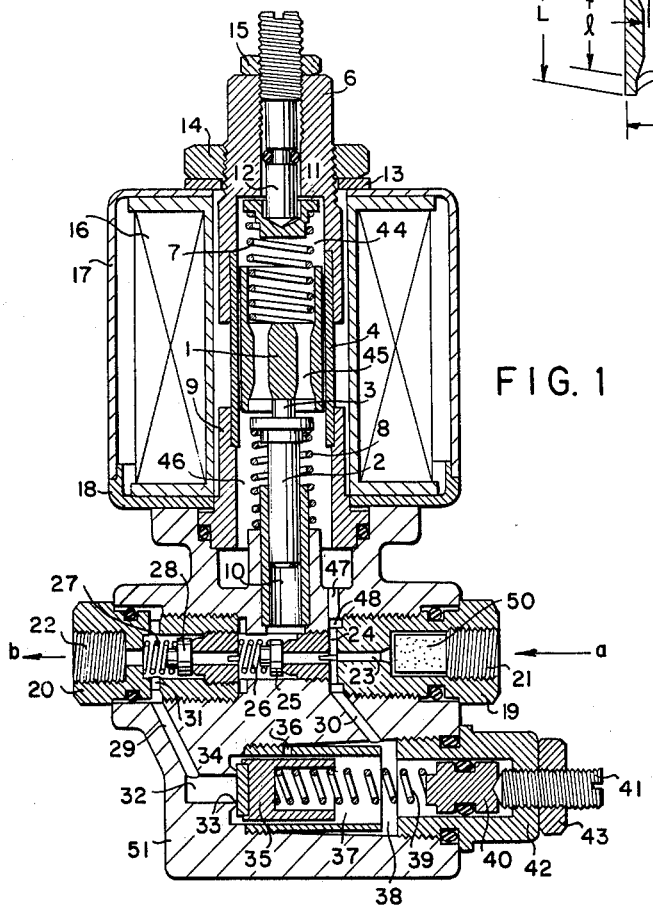
FIG. 1

ELECTROMAGNETIC PUMP

This is a continuation of application Ser. No. 530,273, filed Dec. 6, 1974, now abandoned.

BACKGROUND OF THE INVENTION

This invention relates to compact reciprocating pumps, and more particularly it is concerned with an electromagnetic pump of the reciprocating type.

In the field of reciprocating pumps, it has hitherto been customary to use a device in the form of a pressure accumulator which comprises a resilient means and a diaphragm, or a hollow sack-shaped resilient member in which gas is sealed, in order to minimize the magnitude of pulsations of the liquid delivered by the pumps so that the pumps may deliver the fluid at a constant pressure and in a constant volume at all times. Also, relief valves have hitherto been in use for keeping the delivery pressure of the pumps constant at all times. In one type of such relief valves, a valve body is brought into pressing engagement with a valve seat formed in a leak port by means of a spring or other resilient means so as to close the leak port. If the delivery pressure of the pump rises and exceeds a predetermined level, then the delivery pressure of the pump overcomes the biasing force of the spring, with a result that the valve body is brought out of engagement with the valve seat and the leak port is opened. Thus a quantity of liquid representing the excess pressure is spilled off from the outlet side of the pump to keep the delivery pressure of the pump constant at all times. It is known to combine the aforementioned two separate features from the prior art into a single device where each feature performs its normal function in the combination and no unobvious results are obtained by the combination.

SUMMARY OF THE INVENTION

An object of the present invention is to provide an electromagnetic pump of the reciprocating type which comprises a relief valve mechanism including a balancing plunger which can perform a pressure accumulating function and at the same time can perform the function of adjusting the delivery pressure of the pump to any level as desired and maintaining the same at the adjusted level.

Another object of the invention is to provide an electromagnetic pump of the reciprocating type which is constructed such that the air bubbles formed and contained in the excess volume of liquid returned from the relief valve mechanism to the suction side of the pump can be converted into comminuted from and caused to flow in small quantities into liquid drawn by suction by the pump, so that changes in the delivery pressure of the pump and the volume of liquid delivered by the pump can be prevented which would otherwise occur when the air bubbles are incorporated in the liquid drawn by suction by the pump.

Another object of the invention is to provide an electromagnetic plunger of the reciprocating type in which the resistance offered by the liquid handled by the pump to the operation of the electromagnetic plunger can be minimized.

According to the invention, there is provided an electromagnetic pump of the reciprocating type which comprises a main body, a suction joint connected to the main body and provided with a suction valve, an outlet joint connected to the main body and provided with a discharge valve, a spring-loaded main plunger means reciprocatorily mounted for drawing liquid by suction into and discharging the same from a suction valve chamber defined between the suction valve and the discharge valve, magnetic paths and an electromagnetic coil surrounding the main plunger means, and a relief valve mechanism mounted in the main body, the relief valve mechanism comprising a pressure adjusting cylinder adapted to be brought into communication with the outlet side of the pump, and a pressure adjusting plunger slidably mounted in the pressure adjusting cylinder and normally urged by the biasing force of a spring so as to shut off the interior of the cylinder from the outlet side of the pump, the pressure adjusting cylinder being formed therein with a relief port which is located such that the outlet side of the pump can be made to communicate with the suction side of the pump therethrough when a rise in the delivery pressure of the pump causes the pressure adjusting plunger to move rearwardly against the biasing force of the spring, whereby the excess liquid causing the rise in the delivery pressure can be spilled off from the pressure adjusting cylinder through the relief port and returned to the suction side of the pump and the delivery pressure of the pump can be kept constant at all times.

Other and additional objects and features of the invention will become evident from the description set forth hereinafter when considered in conjunction with the accompanying drawings.

BRIEF DESCRIPTION OF THE DRAWINGS

FIG. 1 is a vertical sectional view of the electromagnetic pump comprising one embodiment of the invention; and FIG. 2 is a substantially central vertical sectional perspective view of essential portions of the electromagnetic pump shown in FIG. 1.

DESCRIPTION OF A PREFERRED EMBODIMENT

FIG. 1 shows a preferred embodiment of the invention in which an electromagnetic plunger 1 is mounted for sliding reciprocating motion in a plunger case 4 made of a non-magnetic material and enclosed by an electromagnetic coil 16. The electromagnetic plunger 1 is connected through a tappet 3 to a delivery plunger 2 adapted to move in sliding reciprocating motion in a cylinder 5 mounted in a main body 51 and having a center axis vertically aligned with the center axis of the plunger case 4. A spring seat 11 is attached to an adjusting rod 12 threadably fitted in an upper magnetic path 6 mounted on an upper portion of the plunger case 4 in airtight relation. A lower magnetic path 9 is mounted on a lower portion of the plunger case 4 in airtight relation. An upper spring 7 is mounted between the spring seat 11 and an upper end of the magnetic plunger 1, while a lower plunger 8 is mounted around the delivery plunger 2. Thus the magnetic plunger 1 is urged to move downwardly by the biasing force of the upper spring 7 while the delivery plunger 2 is urged to move upwardly by the biasing force of the lower spring 8. Since the biasing forces of the two springs 7 and 8 are equal in magnitude, the magnetic plunger 1 and the delivery plunger 2 press against each other with the same force and supported in a predetermined position.

The main body 51 has a suction joint 19 and an outlet joint 20 threadably connected thereto. The suction joint 19 has a built-in filter 50 and is formed therein with a suction duct 23 connected to the filter 50. A slit 24 is formed at an inner end of the suction joint 19. A suction valve chamber 26 is formed in the main body 51 and located adjacent the suction joint 19, with a suction valve 25 being built in the suction valve chamber 26. A discharge valve chamber 27 having a discharge valve 28 built therein is formed in the outlet joint 20. A cylinder 5 is mounted in the main body 51 and receives therein the delivery plunger 2. A pressure chamber 10 is formed in a lower portion of the cylinder 5. The suction joint 19 and the outlet joint 20 are maintained in communication with each other through the suction valve chamber 26, the pressure chamber 10 formed in the cylinder and the discharge valve chamber 27.

A pressure adjusting chamber 38 is formed in the main body 51, and a pressure adjusting cylinder 37 is threadably fitted in the pressure adjusting chamber 38 at its end portion which is located in the vicinity of a valve seat 33 provided at the end of a bore 32 formed in the main body 51. A pressure adjusting plunger 35 is mounted for sliding reciprocating motion in the pressure adjusting cylinder 37 and has attached to its forward end a valve body 34 which is adapted to be brought into engagement with the valve seat 33 to shut off the interior of the pressure adjusting cylinder 37 from the bore 32.

The pressure adjusting chamber 38 has a pressure adjusting screw cover 42 fitted on an end portion thereof which is opposite to the end thereof at which the valve body 34 is located or rightwardly of the pressure adjusting chamber 38 in FIG. 1. The pressure adjusting screw cover 42 has a center axis which is horizontally aligned with the center axis of the pressure adjusting cylinder 37. A pressure adjusting spring seat 40 is provided inside the pressure adjusting screw cover 42, and a pressure adjusting spring 39 is mounted between a forward end of the pressure adjusting spring seat 40 and the pressure adjusting plunger 35. A pressure adjusting screw 41 is threadably inserted in the pressure adjusting screw cover 42 and maintained at its forward end in engagement with a rear end of the spring seat 40. Thus, by turning the pressure adjusting screw 41, it is possible to vary the biasing force of the pressure adjusting spring 39 so as to adjust the force with which the valve body 34 is brought into pressing engagement with the valve seat 33.

The discharge valve chamber 27 in the outlet joint 20 is formed with a port 31 which opens in an angling duct 29 connected to the bore 32 in the main body 51.

A relief port 36 formed in a suitable position in the pressure adjusting cylinder 37 is disposed at right angles to outer and inner wall surfaces of the cylinder 37 and opens in the pressure adjusting chamber 38. An upwardly extending return duct 31 of a small sectional area formed in the main body 51 and opening at one end in the pressure adjusting chamber 38 opens at the other end in an annular groove 48 formed in a position anterior to the suction valve 25 of the pump and corresponding to the slit 24 located at the inner end of the suction joint 19. The main body 51 is formed therein with a lower spring chamber 46 having the lower spring 8 mounted therein and maintained in communication with the annular groove 48 through a leak duct 47.

A coil cover 17 providing cover to the electromagnetic coil 16, a lower plate 18 held between a lower end of the electromagnetic cool 16 and the magnetic path 9, and the magnetic path 6 constitute a yoke which is held in position through a washer 13 by a clamp nut 14.

Upon the electromagnetic coil 16 being excited by passing an electric current thereto, the electromagnetic plunger 1 and the delivery plunger 2 are moved by the magnetic force toward the magnetic path 9 or downwardly in FIG. 1 in the plunger case 4 and the cylinder 5 respectively from the positions in which the two plungers 1 and 2 are supported due to the balancing of the biasing forces of the springs 7 and 8. Upon the electromagnetic current being cut off from the coil 16, the magnetic force is removed or greatly damped and the electromagnetic plunger 1 and the delivery plunger 2 are restored to the original positions by the biasing force of the lower spring 8, thereby completing one reciprocating stroke of the plungers 1 and 2. The upper and lower springs 7 and 8 perform a shock absorbing function by alternately absorbing the energy of weight of the plungers and the inertia of movement thereof at the end of each stroke. The energy thus absorbed in the preceding stroke is released in the next following stroke so as to utilize the energy in increasing the biasing forces of the springs, thereby increasing the amounts of movements of the plungers and improving the performance of the pump.

By turning the adjusting rod 12 either rightwardly or leftwardly, it is possible to effect adjustments of the biasing forces of the upper and lower springs 7 and 8 so as to thereby move upwardly or downwardly the position in which the two plungers 1 and 2 are supported and remain stationary due to the balancing of the biasing forces of the springs 7 and 8. This permits to adjust the magnetic force exerted by the magnetic path 9 or magnetic head on the electromagnetic plunger 1 and the biasing force of the lower spring 8. Thus the forces acting on the two plungers 1 and 2 and the distances covered by their reciprocating movements can be varied as desired, thereby enabling to effect adjustments of the delivery pressure of the pump and the volume of liquid delivered by the pump. In FIG. 1, 15 and 43 refer to lock nuts.

As aforementioned, the two plungers 1 and 2 move in reciprocating motion when an electric current is passed to and cut off from the electromagnetic coil 16. With the suction valve 25 and the discharge valve 28 performing an ancillary action, the plungers 1 and 2 perform a pumping action by moving in reciprocating motion. Thus liquid is drawn by suction in the direction of an arrow *a* to move through an opening 21 of the suction joint 19, the suction duct 23 and the suction valve chamber 26 into the pressure chamber 10, from which the liquid is discharged in the direction of an arrow *b* through the discharge valve chamber 27 and an opening 22 of the outlet joint 20.

If there is a variation in the voltage impressed on the electromagnetic coil 16 of the pump or a discharge nozzle of the pump has its area changed to throttle the flow of liquid, the pressure in the pressure chamber 10 will become higher than the delivery pressure of the pump which is set at a predetermined value by adjusting the biasing force of the pressure adjusting spring 39 by turning the pressure adjusting screw 41. If this is the case, the excess liquid will flow from the discharge valve chamber 27 through the port 31, the angling duct 29 and the bore 32 and move the pressure adjusting plunger 35 rearwardly or rightwardly in FIG. 1 by overcoming the biasing force of the pressure adjusting spring 39. This will bring the valve body 34 mounted at the forward end of the plunger 35 out of engagement with the valve seat 33, so that the fluid will move through the valve seat 33 into the interior of the pressure adjusting cylinder 37. A further increase in the delivery pressure of the pump increases the distance of rearward movement of the pressure adjusting plunger 35 against the biasing force of the pressure adjusting spring 39 till a shoulder of the plunger 35 at the left end thereof reaches the relief port 36. When this is the case, the relief port 36 will be opened and the excess liquid will flow therethrough into the pressure adjusting chamber 38. As the volume of excess liquid moving through the relief port 36 into the pressure adjusting chamber 38 increases, the biasing force of the pressure adjusting spring 39 will increase again and overcome the pressure of the liquid applied to the pressure adjusting plunger 35, so that the plunger 35 will move forwardly or leftwardly in FIG. 1. Thus the delivery pressure of the pump is maintained at the predetermined level by repeating this operation.

From the time the valve body 34 is brought out of engagement with the valve seat 33 till the relief port 36 is opened, the pressure adjusting plunger 35 moves in sliding reciprocating motion in the pressure adjusting cylinder 37. This movement of the plunger 35 enables the relief valve mechanism according to the invention to perform a shock absorbing action and a pressure accumulating action while minimizing the magnitude of pulsations of the liquid delivered by the pump, so that the pump can deliver the liquid at a constant pressure and in a constant volume. With the pressure adjusting plunger 35 moving forwardly and rearwardly to open and close the relief port 36 at all times, the excess liquid is discharged from the discharge valve chamber 27 to control the pressure of the liquid therein, so that the delivery pressure of the pump can be maintained at the predetermined level. As aforementioned, the delivery pressure of the pump can be set at any level as desired by turning the pressure adjusting screw 41 either rightwardly or leftwardly to thereby adjust the biasing force of the pressure adjusting spring 39 which urges the valve body 34 at the forward end of the pressure adjusting plunger 35 into engagement with the valve seat 33. Thus the relief valve mechanism according to the invention relies on the balancing plunger for simultaneously performing the functions of accumulating pressure and effecting adjustments of the delivery pressure of the pump.

In addition to the aforesaid delivery pressure adjusting means relying on the balancing plunger for adjusting the pressure, the electromagnetic pump according to the invention is further provided with means for adjusting the delivery pressure of the pump and the volume of liquid delivered by the pump which relies on the adjusting rod 12 as described above. The reason why this additional means is provided will now be described.

The position of the electomagnetic plunger 1, which is balanced and disposed stationary by being pressed by the upper and lower springs 7 and 8 whose biasing forces are equal to each other, relative to the position of the magnetic path 9 and the electromagnetic coil 16, and the biasing forces of the springs 7 and 8 are matters which have a significant bearing upon the performance of an electromagnetic pump. These matters are decided after careful studies. However, no matter how severe tolerances may be, there may be variations in the dimensions of the parts of the pump. There may be variations in the co-efficient of friction due to differences in the tolerances for the finishes of surfaces of the parts. There may be variations in the spring constant of the springs due to variations in the tensile strength and dimensions thereof. There may be variations in magnetic permeability due to variations in the composition of the magnetic material. Accumulated errors are important factors which are concerned in the functioning of electromagnetic pumps and which cause variations in the performance of the pumps no matter how severe the tolerances may be.

If it is desired to eliminate variations in the performance of the electromagnetic pumps, it is essential that the materials used have a uniform composition and mechanical strength and that the parts should be machined with a high degree of precision and assembled by paying close attention and with an advanced skill. This will greatly increase the production cost and make the proposal economically unacceptable. Moreover, the attempt will encounter technical difficulties.

For reasons mentioned above, it is necessary to provide means for effecting adjustments of the relative positions of the electromagnetic plunger 1, the magnetic path 9 and the electromagnetic coil 16 and the biasing forces of the springs 7 and 8, so as to adjust the delivery pressure of the pump to a maximum level.

Adjustments of the delivery pressure of a pump by means of a relief valve or the like can be effected only when the delivery pressure of the pump is below its maximum level. Thus, when the delivery pressure of a pump is far below the maximum level for some reason, the relief valve is of no value in improving the performance of the pump and some ancillary means must be employed to attain the end. In actual practice, the ancillary means comprising the adjusting rod 12 has the effect of increasing the delivery pressure of the pump. For example, when the distance between the electromagnetic plunger 1 and the magnetic path 9 which serves as a magnetic head or the magnetic gap or the relative positions of the electromagnetic plunger 1 and the electromagnetic coil 16 is varied by 0.5 millimeter, the delivery pressure can be increased from 7 $kg/cm^2$ to 10 $kg/cm^2$ in an extreme case.

Thus, by first turning the adjusting rod 12 to raise the delivery pressure of the pump to a level which is much higher than the desired level and then turning the pressure adjusting screw 41 to adjust the delivery pressure to the desired level, it is possible to maintain the delivery pressure of the pump substantially at the desired level even if there is a variation in the voltage impressed on the electromagnetic coil 16 or the outlet nozzle is throttled in a predetermined range, thereby precluding a markedly high increase or decrease in the delivery pressure of the pump.

The excess liquid flowing through the relief port 36 into the pressure adjusting chamber 38 moves through the return duct 30 into the annular groove 48 disposed anterior to the suction valve 25. Then the excess liquid is drawn into the suction valve chamber 26 through the slit 24. If the liquid is a volatile liquid such for example as kerosene, light oil or gasoline, it may be partly gasified owing to the frictional dragging of the pressure adjusting plunger 35 on the pressure adjusting cylinder 37, or minuscule air bubbles contained in the fluid may stagnate in the pressure adjusting chamber 38, the return duct 30 or the annular groove 48 and gradually increase in volume. This may lead to the development of a vapor lock phenomenon in the suction valve 25 or cause caviation to occur in the pump. The mixture of the liquid and gas thus produced may cause a change to occur in the pressure and volume of the liquid handled by the pump, thereby reducing the performance of the pump.

In order to obviate this disadvantage, the pressure adjusting chamber 38 is constructed such that it tapers divergingly in going from its forward end toward its rearward end or from the portion thereof in which the relief port 36 is disposed to the portion thereof which is adjacent the pressure adjusting screw cover 41, so that the air bubbles flowing into the chamber 38 through the relief port 36 will float quickly to the top to be introduced into the return duct 30. The return duct 30 which extends upwardly has its cross-sectional area minimized, so that the fluid returned to the suction valve chamber 23 can pass quickly through the return duct 30 to the chamber 26, thereby enabling the air bubbles to the converted into comminuted form and precluding stagnation of the air bubbles in the return duct 30.

As aforementioned, the return duct 30 which is disposed above the pressure adjusting chamber 38 has its cross-sectional area reduced in order to cause the air bubbles to be separated from the liquid and float to the surface of the liquid, so that the minuscule air bubbles can pass quickly therethrough into the annular groove 48. The minuscule air bubbles are incorporated in small quantities in the liquid drawn by suction from outside into the pump, thereby exerting to influences on the performance of the pump. If the air bubbles grow into substantially large masses relative to the size of the plungers or the volume of the suction valve chamber 26 or pressure chamber 10, vapor lock would instantly occur in a reciprocating pump, particularly an electromagnetic pump in which the delivery plunger 2 has a small diameter and a short stroke, and cause the liquid to be delivered in an unstable manner by the pump.

In the electromagnetic pump of the aforesaid type, the liquid may leak through a small gap between the delivery plunger 2 and the cylinder 5 into the lower spring chamber 46. The liquid thus invading the lower spring chamber 46 will gradually work its way into the plunger case 4 and vertical bores 45 formed in the electromagnetic plunger 1, to be finally collected in an upper spring chamber 44 in which the upper spring 7 is mounted. In the case of plunger pumps of the free piston type to which this embodiment belongs and in which the diameter or cross-sectional area of the electromagnetic plunger 1 is much larger than that of the delivery plunger 2, resistance offered by the liquid collected in the plunger case 4 and the upper spring chamber 44 to the movement of the electromagnetic plunger 1 is so great that the operation of the pump is greatly interfered with, with a result that the efficiency of the pump is inevitably reduced. In order to obviate this disadvantage, there is provided according to the invention a leak duct 47 which is formed in the main body 51 to maintain communication therethrough between the lower spring chamber 46 and the annular groove 47 on the suction side of the pump so as to return leak to the suction side.

The liquid handled by the electromagnetic pump can be (a) drawn by suction for delivery from the liquid level of a tank disposed in a position higher than the position of the pump and (b) drawn from a tank disposed in a position lower than the position of the pump. In the latter case, when the full wave of a commercial alternating current source is employed for moving the electromagnetic plunger 1 in reciprocating motion, the number of strokes of the electromagnetic plunger will be 6,000 per minute when the power source is 50 Hz and 7,200 when the power source is 60 Hz; when a half-wave rectified current is employed, the number of strokes will be 3,000 per minute when the power source is 50 Hz and 3,600 when the power source is 60 Hz. Thus the electromagnetic plunger moves at high speeds in operation. As a result, the movement of the electromagnetic plunger 1 having a larger diameter than the delivery plunger 2 may draw the liquid from the suction side of the pump through the leak duct 47 into the plunger case 4 and the upper and lower spring chambers 44 and 46, thereby greatly interfering with the operation of the pump.

In order to keep the liquid from being drawn through the leak duct 47 into the lower spring chamber 46, the elongated suction duct 23 of a relatively small diameter is provided in the suction joint 19 so that resistance may be offered to a certain degree to the flow of liquid drawn by suction into the pump and the rate of movement of the liquid therethrough may be increased. This has the effect of reducing the pressure of liquid passing through the suction duct 23, thereby drawing the liquid from the upper and lower spring chambers 44 and 46 and the plunger case 4 through the leak duct 47 while preventing the liquid from being drawin into the lower spring chamber 46 through the leak duct 47. Preferably, the filter 50 has a large thickness. The larger the thickness of the filter 50, the greater is the resistance offered by the filter to the liquid drawn by suction into the pump. Moreover, the pressure of the liquid drawn into the pump is reduced and the positive water head existing on the suction side can also be reduced.

As aforementioned, the pressure of liquid on the suction side of the pump can be reduced so that negative pressure may exist on the suction side of the pump according to the invention. This offers the additional advantage of facilitating the flow of the excess liquid which is returned from the pressure adjusting chamber 38 to the suction valve chamber 26 through the return duct 30, the annular groove 48 and the slit 24 as aforementioned to thereby absorb the excess delivery pressure.

The diameter and length of the suction duct 23 may vary depending on the specifications of the pump or the positive or negative value of the suction water head, the diameter, the number of strokes and the length of stroke (the volume of liquid delivered by the pump) of each of the electromagnetic plunger and the delivery plunger, the type of liquid drawn and delivered, the viscosity and other properties and conditions of the liquid handled, and the delivery pressure of the pump.

The resistance offered to the operation of the electromagnetic plunger 2 by the liquid leaking through a small gap between the cylinder 5 and the delivery plunger 2 and the liquid invading the lower spring chamber 46 through the leak duct 47 due to the positive water head existing on the suction side of the pump is eliminated by the aforementioned means according to the invention. However, the aforesaid leak of liquid or liquid invasion may gradually increase due to some cause and the liquid may fill the lower spring chamber 46 and the plunger case 4. If this is the case, the operation of the electromagnetic plunger 1 will be interfered with. In order to prevent this phenomenon, additional prevention means is provided as follows according to the invention.

As aforementioned, vertical bores 45 extending through the electromagnetic plunger 1 are provided. The vertical bores 45 each have an opening end which is gently sloped and greatly chamfered so as to reduce the impact of the liquid thereon and the resistance offered by the liquid. In determining the diameter, positions, length and number of vertical bores 45, the following factors should be taken into consideration. First of all, the cross-sectional area of the electromagnetic plunger 1 should be sufficiently great to permit the necessary lines of magnetic force to pass therethrough. Secondly, the mass of the electromagnetic plunger 1 should be sufficiently great to produce the energy of inertia necessary for increasing the capabilities of the pump when the electromagnetic plunger performs a spring hammering action. Thirdly, the viscosity and other properties of the liquid handled should be considered.

FIG. 2 is a vertical sectional perspective view of one form of the electromagnetic plunger according to the invention. In the figure, D is the diameter of the electromagnetic plunger; L is the length of the electromagnetic plunger; d is the diameter of each vertical bore; $l$ is the length of each vertical bore; and N is the number of the vertical bores. It has been ascertained as the results of experiments that, when the liquid handled by the pump is water, kerosene, light oil and the like which are low in viscosity, no great influences are exerted on the normal operation of the pump if the following relations hold. Let us assume that $l = L/2 \sim L$.

When $l \approx 0.75D$, $$6\,(\pi d^2/4)\,N \geqq \pi/4)D^2.$$

This shows that the sum of the cross-sectional areas of the vertical bores should be over 1/6 the cross-sectional area of the electro-magnetic plunger.

When $l \approx 1.5D$, $$5(\pi d^2/4)\,N \geqq (\pi/4)D^2.$$

This shows that the sum of the cross-sectional areas of the vertical bores should be over 1/5 the cross-sectional area of the electromagnetic plunger.

From the foregoing description, it will be appreciated that the resistance offered by the liquid to the operation of the plunger can be reduced and that consequently the cross-sectional area of each vertical bore 45 can be reduced if the vertical bores 45 are located at the shortest distance with respect to the vertical dimension of the electromagnetic plunger 1.

It has also been ascertained as the results of the experiments that it is more effective in maintaining the pump at a high operation efficiency to provide a plurality of vertical bores 45 disposed equidistantly from one another on the circumference of a circle with the center vertical axis of the electromagnetic plunger 1 as its center, rather than to provide only one vertical bore disposed along the center vertical axis of the plunger 1.

Although the vertical bores 45 are formed in the electromagnetic plunger 1 in order to eliminate the resistance offered by the liquid in the plunger case 4 to the operation of the plunger 1, it should be understood that it is possible to eliminate the resistance offered by the liquid working its way into the plunger case 4 and permit the electromagnetic plunger 1 to operate smoothly if the aforementioned means for preventing the invasion of liquid is provided. The vertical bores 45 only serve as a failsafe to ensure that there is absolutely no interference in the operation of the electromagnetic plunger.

The reason why the valve body 34 attached to the pressure adjusting plunger 35 is brought by the biasing force of the pressure adjusting spring 39 into engagment with the valve seat 33 provided in the main body 51 and located leftwardly of the pressure adjusting cylinder 37 to close the same will now be described. If the valve seat 33 were open in the initial stages of operation of the pump when the air in the liquid passageway on the suction side of the pump is removed prior to the drawing of the liquid by suction into the pump, the outlet side of the pump would be maintained in communication with the suction side thereof through a small gap between the pressure adjusting cylinder 37 and the pressure adjusting plunger 35 and the efficiency with which suction is effected by the pump will be reduced, so that difficulty would be encountered in removing the air or it would take a long time to draw the liquid by suction.

In case a liquid, particularly a liquid of low viscosity, is drawn by suction from a tank disposed in a position higher than that of the pump and pressurized before delivery, the liquid moving through the return duct 30 from the plunger case 4 to the pressure adjusting chamber 38 will move through the small gap between the pressure adjusting cylinder 37 and the pressure adjusting plunger 35 and move toward the outlet side of the pump when the pump is inoperative. If the pump is used as a means for pressurizing and delivering fuel oil to a burner, there will be the danger of an explosion or a fire which might be caused by the fuel oil reaching the hearth when the pump is inoperative. In order to prevent such accident, the valve body 34 and the valve seat 33 performs the function of a check valve arrangement. Such arrangement is effective to increase the suction efficiency of the pump or prevent leak of liquid when the pump is inoperative, depending on whether the pressure of the suction head applied to the suction side of the pump is positive or negative.

While the pump is in operation, the pressure adjusting plunger 35 moves in sliding reciprocating motion leftwardly and rightwardly in the pressure adjusting cylinder 37, thereby acting as a pressure accumulator. At the same time, when the pressure in the pump exceeds a predetermined level, then the pressure adjusting cylinder 35 moves further rightwardly to open the relief port 36 and permit the excess liquid to move therethrough to the pressure adjusting chamber 38, so as to thereby maintain the delivery pressure of the pump at the predetermined level at which the pump is set by turning the pressure adjusting screw 41 to adjust the biasing force of the pressure adjusting spring 39. The air bubbles contained in the excess liquid vented to the pressure adjusting chamber 38 readily float to the surface of the liquid by virtue of the construction of the upwardly extending return duct 30 of a relatively small cross-sectional area and converted into comminuted form. The excess liquid containing air bubbles in comminuted form is returned quickly to the suction side. Thus the pressure is reduced at all times by the increased resistance offered to the passage of the liquid and an increase in the rate of flow depending on whether the suction head is positive or negative. The returned liquid is introduced into the annular groove 48 on the suction side which is maintained in negative pressure and incorporated in the liquid drawn by suction from outside. In this way, the occurrence of vapor lock or cavitation is prevented and variations in the delivery pressure of the pump and the volume of the liquid delivered by the pump are prevented, thereby permitting the pump to operate efficiently.

What is claimed is:

1. An electromagnetic pump comprising a pump body, a cylinder, a pressure chamber, a suction valve and a discharge valve communicating with the pressure chamber, an electromagnetic coil mounted concentrically with an extension line of the longitudinal axis of said cylinder, a plunger case disposed within said electromagnetic coil, a delivery plunger and an electromagnetic plunger fitted in said cylinder and said plunger case, respectively, for reciprocating sliding movement and in abutting engagement with each other, said plungers being retained in pressure engagement between springs, characterized by a pressure adjusting cylinder provided within said pump body and including means communicating said pressure adjusting cylinder with the suction and delivery sides of the pump, a pressure adjusting plunger fitted within said pressure adjusting cylinder for reciprocating sliding movement and with an extremely small clearance between the outer diameter of the pressure adjusting plunger and the inner diameter of the pressure adjusting cylinder in a range where the sliding movement thereof is not prevented, said pressure adjusting plunger having at the top end thereof a valve body which engages a valve seat at an end of a passage connecting the delivery side of the pump with the pressure adjusting cylinder to thereby constitute a check valve, and said pressure adjusting plunger also having a shoulder portion at the top end thereof to thereby constitute a variable orifice relief throttle valve in the form of piston-valve together with a relief port perforated through the side wall of said pressure adjusting cylinder, said pressure adjusting plunger having said check valve and said relief throttle valve constituted separately, a pressure adjusting spring biasing the pressure adjusting plunger so as to close said check valve and said relief throttle valve, whereby said check valve is first opened in a process of rising in pressure in said passage after operation of the pump and on exceeding a predetermined pressure, said variable orifice relief throttle valve operates to adjust the opening degree of the orifice and relief part to thereby control the amount of leak from the delivery side of the pump through said passage, past said check valve and through said relief port so that the delivery pressure of the pump may be maintained at predetermined value whereas from the time said check valve is opened till immediately before said variable orifice relief valve is opened, the pressure adjusting plunger moves in reciprocating movement by the extension and contraction of the pressure adjusting spring to thereby level the delivery pulsation of the pump and operate as an accumulator performing a pressure accumulating action.

2. An electromagnetic pump as set forth in claim 1, characterized in that the relief port of said variable orifice mechanism is located in a position below the suction valve of the pump, and a return duct is formed in the pump body to return the excess liquid under pressure from said relief port into the inlet side of the suction valve of the pump, said return duct being of a relatively small cross-sectional area and extending upwardly, so that the air bubbles contained in the excess liquid under pressure flowing through said return duct may be separated and converted into comminuted form, and returned to said suction side without accumulating and stagnating the air bubbles, and a suction joint connected to the inlet side of the pump body is formed therein with a small bore-like suction duct having the smallest cross-sectional area out of the passages at the suction side and a relatively long length, whereby a flow resistance can be imparted to the liquid flowing through said suction duct to cause more decrease in pressure between the duct and the suction valve, so that the excess liquid under pressure from the return duct and the liquid staying in the plunger case, and the lower spring chamber can be drawn easily and quickly into the suction valve to thereby reduce or eliminate the vapor lock and any resistance against the operation of the electromagnetic plunger due to said liquid.

* * * * *

UNITED STATES PATENT OFFICE
CERTIFICATE OF CORRECTION

PATENT NO. : 4,021,152
DATED : May 3, 1977
INVENTOR(S) : AKIRA TOYODA

It is certified that error appears in the above-identified patent and that said Letters Patent are hereby corrected as shown below:

Col. 1, line 51, the word "from" should read --form--.

Col. 12, line 4, the word "part" should read --port--.

Signed and Sealed this
*ninth* Day of *August 1977*

(SEAL)

*Attest:*

RUTH C. MASON
*Attesting Officer*

C. MARSHALL DANN
*Commissioner of Patents and Trademarks*